US007914003B2

(12) United States Patent
Miller

(10) Patent No.: US 7,914,003 B2
(45) **Date of Patent: *Mar. 29, 2011**

(54) GAMING DEVICES AND METHODS OF PLAYING CARD GAMES WITH INDICATOR OF CARDS PLAYED FROM PREVIOUS HANDS

(76) Inventor: Randy Miller, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/152,960

(22) Filed: May 19, 2008

(65) Prior Publication Data

US 2008/0217857 A1 Sep. 11, 2008

Related U.S. Application Data

(63) Continuation of application No. 11/083,377, filed on Mar. 18, 2005, now Pat. No. 7,374,172, which is a continuation of application No. 10/302,061, filed on Nov. 21, 2002, now Pat. No. 6,869,074.

(51) Int. Cl.
*A63F 1/00* (2006.01)
*A63F 13/00* (2006.01)

(52) U.S. Cl. ..... 273/292; 273/138.2; 463/12

(58) Field of Classification Search ..... 273/148 R, 273/274, 138.1, 138.2, 143 R, 292; 463/18, 463/17, 19, 20, 22, 12
See application file for complete search history.

(56) References Cited

U.S. PATENT DOCUMENTS 5,123,649 A 6/1992 Tiberio
5,154,429 A 10/1992 Le Vasseur
5,192,076 A 3/1993 Komori
5,586,766 A 12/1996 Forte et al.
5,732,949 A 3/1998 Josephs
5,785,606 A 7/1998 Marquez
5,791,989 A 8/1998 Slinkman
5,954,335 A 9/1999 Moody
5,984,308 A 11/1999 Herrmann
6,203,428 B1 3/2001 Giobbi
6,217,447 B1 4/2001 Lofink et al.
6,220,959 B1 4/2001 Holmes, Jr. et al.
6,299,531 B1 10/2001 Bommarito
6,311,978 B1 11/2001 Moody
6,322,075 B1 11/2001 DeFranco
6,371,482 B1 * 4/2002 Hall, Jr. ..... 273/138.1
6,406,023 B1 6/2002 Rowe
6,612,926 B1 9/2003 Dabrowski
7,374,172 B2 * 5/2008 Miller ..... 273/269
2002/0103017 A1 8/2002 Odom et al.
2002/0155872 A1 10/2002 Odom et al.
2002/0185814 A1 12/2002 Moody
2004/0053657 A1 * 3/2004 Fiden et al. ..... 463/16

OTHER PUBLICATIONS

Lottery Information Sheet, Ohio 3 Digit History & Scoreboard, Gutis Apse, 1988.

* cited by examiner

*Primary Examiner* — Benjamin H Layno
(74) *Attorney, Agent, or Firm* — Daniel P. Burke & Associates, PLLC

(57) ABSTRACT

Gaming devices and methods of playing games wherein an indication of the cards which have already been discarded or dealt is displayed for a player to view prior to making a decision. One embodiment is directed to a gaming device comprising a video display which is designed for the play of Blackjack. Other embodiments are directed to table versions of the present invention wherein physical playing cards are actually dealt to one or more players. At the conclusion of each hand, an indication of the cards dealt is displayed for viewing by all of the players.

9 Claims, 6 Drawing Sheets

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

FIG. 4

GAMING DEVICES AND METHODS OF PLAYING CARD GAMES WITH INDICATOR OF CARDS PLAYED FROM PREVIOUS HANDS

RELATED APPLICATION DATA

This application is a continuation application of U.S. patent application Ser. No. 11/083,377 filed on Mar. 18, 2005 (now U.S. Pat. No. 7,374,172), which is a continuation of U.S. patent application Ser. No. 10/302,061 filed on Nov. 21, 2002, now U.S. Pat. No. 6,869,074 which issued on Mar. 22, 2005.

The present invention is directed to gaming devices and methods of playing card games wherein cards played from previous hands are discarded and displayed for ready viewing by players.

BACKGROUND

It is well recognized in the gaming industry that persons playing card games at a casino will have a distinct advantage if, while playing a card game, they know which cards have already been played from the collection of cards being dealt. For example, when playing the game of Blackjack, players have an opportunity to draw additional cards. Those cards are commonly drawn from a card shoe containing a plurality of 52 card decks. Since a number of hands are typically dealt from such a card shoe, during the play of multiple hands, it is difficult and sometimes impossible for players to view all of the cards which have been played by all players and the dealer. Moreover, it is difficult for players to remember all of the cards which have been played. In fact, it is common practice for casinos to ban the practice of card counting. Players which are suspected of card counting are typically ostracized from casinos, since knowledge of the cards previously played offers players a significant advantage. The advantage arises from the player's ability to predict which cards are remaining in the card shoe. For example, if many high value cards have previously been played, then the player will realize the likelihood of drawing a low value card is high, and vice versa. Since casinos have traditionally desired to avoid increasing the players chances of winning, casinos have disfavored devices or methods of play which tend to increase the players chances of recalling which cards have already been dealt from a card shoe. Those skilled in the art will appreciate that this same prevalent thinking has also applied to other games where players have had the opportunity to draw cards from a predetermined collection of cards, for example a single deck or multiple decks of cards.

It is also common practice in the gaming industry to have all cards played during a card deal on an electronic gaming device, e.g. a video poker machine, to be effectively "reshuffled" after each card deal. The practice of reshuffling between card deals prevents players from counting cards and gaining an advantage in subsequent deals.

Players often desire to play new games of chance, particularly games which are perceived to offer greater likelihoods of achieving a winning outcome or games which offer opportunities for higher payouts.

SUMMARY OF THE INVENTION

Embodiments of the present invention are directed to gaming devices and methods of playing card games wherein an indication which cards have already been discarded is displayed for the player or players to view. The various aspects of the present invention are contrary to traditional casino practices which tended to impede a players ability to see and/or recall the cards previously played.

One preferred aspect of the present invention is directed to a gaming device comprising a video display which is designed for the play of Blackjack. Cards are dealt to one or more hands from a simulated multi-deck card shoe. For example, a single player may be provided with the opportunity to play five hands of Blackjack during a single card hand. After the hand is played or after the cards are dealt, an indication of the cards used is shown in a discarded card table. Therefore, when a player is deciding whether to draw another card, the player can readily see which cards have already been played. If the player needs an ace and all of the aces have already been discarded, then the player will know that it would be futile to try to draw an ace. In a similar manner, the player can assess the likelihood of drawing relatively high or low cards from the number of such cards already discarded.

Another preferred embodiment of the present invention comprises providing a player with an opportunity to play a game wherein cards are drawn from a multi-deck card shoe, for example, a six deck shoe and wherein a "cut card" is randomly placed in the deck. The player or players are then dealt cards from those cards forward of the "cut card". When a cut card or similar step is taken to establish a subset of cards from which cards will be dealt, players cannot actually determine the likelihood of drawing a specific card but can still get an idea of the likelihood of drawing one or more specific value cards. Specific card values or cards falling within predetermined ranges which have been discarded and dealt in previous hands are available for display to a player. The player may be required to meet certain criteria, such as wagering a predetermined amount or making an additional payment, in order to receive access to some or all of the information regarding previously played cards.

Another aspect of the present invention is directed to a keno game wherein a plurality of keno-type games are played by drawing indicia, e.g. numbers, from a single pool of numbers. According to this embodiment of the present invention, players are provided with an opportunity to wager on one or more keno games subsequent to the first keno game while having the ability to view which numbers had been played on the initial or other previous games.

Another aspect of the present invention comprises methods and electronic gaming devices, e.g. video card game machines wherein cards are not reshuffled after every deal. According to these embodiments of the present invention, a player will receive multiple deals, each of which can comprise one or more hands, out of a single collection of cards.

Other aspects of the present invention are directed to table versions of the present invention wherein physical playing cards are actually dealt to one or more players. At the conclusion of hand, an indication of the discarded cards is displayed for viewing by all of the players. According to one aspect of this invention, the actual cards are provided with some indicia which can be electronically read. In this manner, the cards can be automatically tallied and displayed by simply feeding them through a card reader. Alternatively, each individual player can be provided with an opportunity to obtain his own indication of some or all of the previously discarded cards. Therefore, either a common display can be provided or each player can be provided with his own display. Providing players with their own displays will facilitate requiring additional payments or other player-specific criteria.

BRIEF DESCRIPTION OF THE DRAWINGS

FIG. 4 illustrates a keno display for use with another embodiment of the present invention.

DETAILED DESCRIPTION

Various embodiments of the present invention provide a player with a discernable indication of which cards have been discarded, or, alternatively, which cards have been dealt from the collection of cards from which cards are dealt, e.g., a multi-deck card shoe. If the display is set to indicate all previously discarded cards then cards presently being utilized in a hand being played will not be shown in the discarded card screen. Alternatively, in order to provide a player with a single, viewable location for determining cards which are no longer in the card deck and which therefore can not be drawn, an alternative embodiment of the present invention lists all cards which have been dealt in the discard display. While a visible display is the preferred manner of indicating to players the number of cards of each type which have already been discarded, it is also within the scope of the present invention to provide this information to players in other forms, e.g. audibly.

Figure 1:
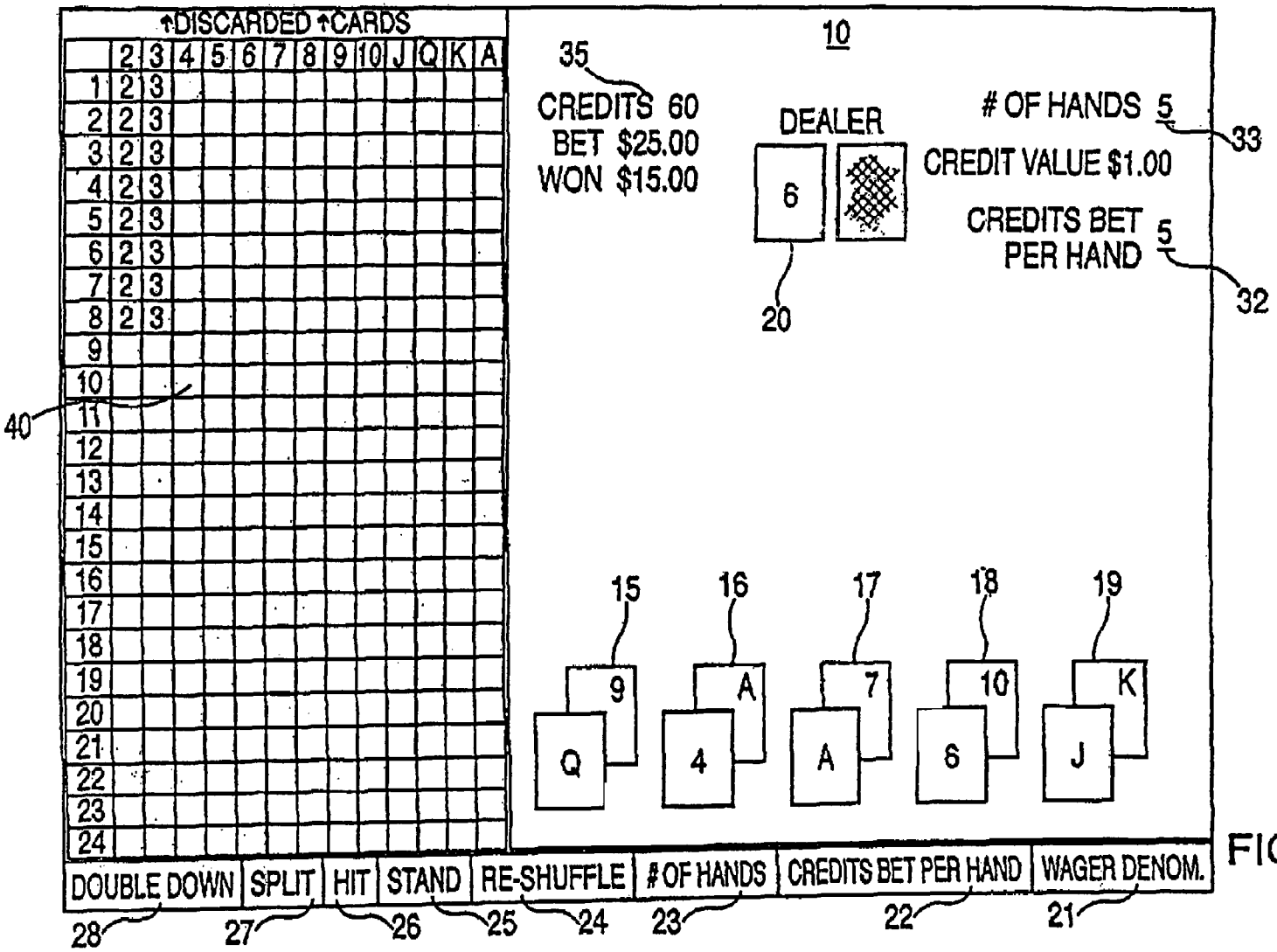
FIG. 1 illustrates a screen display for use with one embodiment of the present invention.

FIG. 1 is one illustrative example of a touch screen which can be utilized with one embodiment of the present invention. While a touch screen appears to be particularly suitable for electronic gaming device versions of the present invention, the present invention is not limited to use on touch screens. Furthermore, since the particular electronic components, whether mechanical, electro mechanical or electronics, as well as the software, programmable devices or other components used to build various embodiments of the present invention are within the scope of one skilled in the art, detailed description of those components is not provided herein. In this preferred embodiment, a player wagers credits on games of Blackjack. In this illustrated embodiment, five separate hands 15-19 are displayed on the screen along with a dealer hand 20. A player or players are provided with input controls which, in this illustrated embodiment, are designated areas on the touch screen. The designated areas on this illustrated embodiment provide a player with the ability to provide input. "WAGER DENOM" area 21 permits a player to choose the denomination of the amount being wagered, for example the player may choose between 25¢, $1.00, or $5.00 denominations. The "CREDITS BET PER HAND" touch area 22 allows a player to choose how many credits are being wagered on each hand being played. For example, the player can be provided with the option of wagering any numbers of credits, e.g. from 1 to 5 credits, per hand being played. In this illustrated embodiment the number of credits bet per hand is illustrated in screen area 32. The "NUMBER OF HANDS" area permits a player to choose the number of hands played per deal. In this illustrated embodiment, the screen is displaying five hands and the number of hands selected is indicated in screen area 33.

According to the method of play of this illustrated embodiment, the particular hand which is being played is highlighted or otherwise provided with some clear indicia so that the player can readily determine which hand is being played. For example, the hand being played can flash or be illuminated brighter or with different colors from the other hands. A hand remains in play, according to this illustrated embodiment, until a player goes "BUST" i.e., goes over twenty-one, or until the "STAND" button has been touched. Touch screen areas 24-28 provide a player with the option to reshuffle by touching "RESHUFFLE" area 24, to stand by touching "STAND" area 25, to take another card by touching "HIT" area 26, to split the hand by touching "SPLIT" area 27, or to double down by touching "DOUBLE DOWN" area 28. The illustrated display screen 10 also comprising wager display 35 area which indicates the number of credits still available, the amount wagered during a game, and the number of credits won during a given game.

Illustrated display screen also advantageously comprises a discarded card display 40. The illustrated discarded card area 40 comprises twenty four rows and thirteen columns. The twenty four rows provide one row for each card denomination for six decks of cards. Those skilled in the art will appreciate that each deck of cards comprises four cards of each denomination, for example, four Jacks. This illustrated embodiment is designed for use with a six deck shoe simulation, therefore, it is possible to have twenty four cards of each value discarded. The thirteen columns represent a single column for each card denomination. According to this illustrated embodiment, there is no distinction between cards of different suits. From the present description, those skilled in the art will appreciate that for other types of card games, it may be desirable to provide an indication of particular suits or particular cards of a particular suit that have been discarded.

Therefore, in this illustrated embodiment, cards are only listed in the discarded card area after a particular deal is over and the cards have been discarded. It is also within the scope of the present invention to discard a particular hand after that particular hand has gone bust. According to this illustrated embodiment, only cards which have been discarded are shown in the discarded card area 40. As noted above, it is also within the scope of the present invention to provide a display which lists all cards which have been dealt. In an embodiment which indicates all cards once the cards have been dealt, the dealers face down card would not preferably be indicated.

While this illustrated embodiment of the present invention comprises a discarded card area on the same screen as the game being played and the input areas, it is also within the scope of the present invention to have the "DISCARDED CARD" display or a "DEALT CARD" display separate from the game display.

As used herein, the term "DISCARDED" is not limited to cards which have been displayed and then not used in any card hand. The term "DISCARDED" as used herein includes all cards which have been used in previous hands, whether those cards were used in the hand of a player or a dealer, or even if those cards were not incorporated or used in any hand of a game participant. The term "CARD INDICIA" is used to indicate images of playing cards as well as the playing cards themselves. Therefore, the term "CARD INDICIA" refers to both visual displays of card images on a screen as well as cards placed on a table game. The selection of cards displayed in gaming device embodiments of the present invention is preferably determined randomly.

Even though the card images are determined randomly, the present invention is not limited nor dependent upon any one particular type of electronic embodiment or circuitry. While one or more random number generators or other random signal generators can be utilized with various embodiments of the present invention and those devices may generate signals which are subsequently converted into signals producing card indicia on a display screen, for simplicity, all such signals, whether subsequent to or prior to conversion to a signal which creates the image of a playing card on a screen are referred to herein as "CARD INDICIA".

In a table game format of a conventional Blackjack game, those skilled in the art will appreciate that a card shoe may typically comprise a plurality of card decks, for example, six decks of cards. A "cut card" is typically inserted into the card shoe and then cards forward of the "cut card" are then dealt. When the dealer gets down to the "cut card" the cards are reshuffled. According to the various embodiments of the present invention, the use of a "cut card" can be simulated. When a "cut card" is used, the pool of cards from which any particular displayed card is chosen will be a subset of the total number of card indicia in the number of decks utilized.

From the present description, those skilled in the art will appreciate that after playing a game of the present invention for awhile and as the number of displayed discarded cards increases, players will have an advantage since they will have a better idea of cards which may be dealt. In order to avoid providing this advantage to undeserving players, e.g., a different player who uses a gaming device after a first player had played for awhile, the gaming devices of the present invention are preferably designed to reset and reshuffle if a predetermined time span has elapsed between the end of one game and the start of another game. For example, if a gaming device sits idle for thirty seconds, then the game may automatically reset and reshuffle. The length of time can be set as desired by the manufacture or its designee. This feature will also advantageously tend to hold players at a specific gaming device once the number of cards in the discarded card display becomes significant.

As noted above, it is also within the scope of the present invention to provide an indication of all cards dealt up to any given time, rather than just the cards which were dealt in previous games/hands. If the display indicates which cards have been dealt, then a player has a single, convenient location to view for an indication of possible cards to be drawn and would not have to add the cards displayed on the display screen to the cards shown on the discarded card screen.

Figure 2:
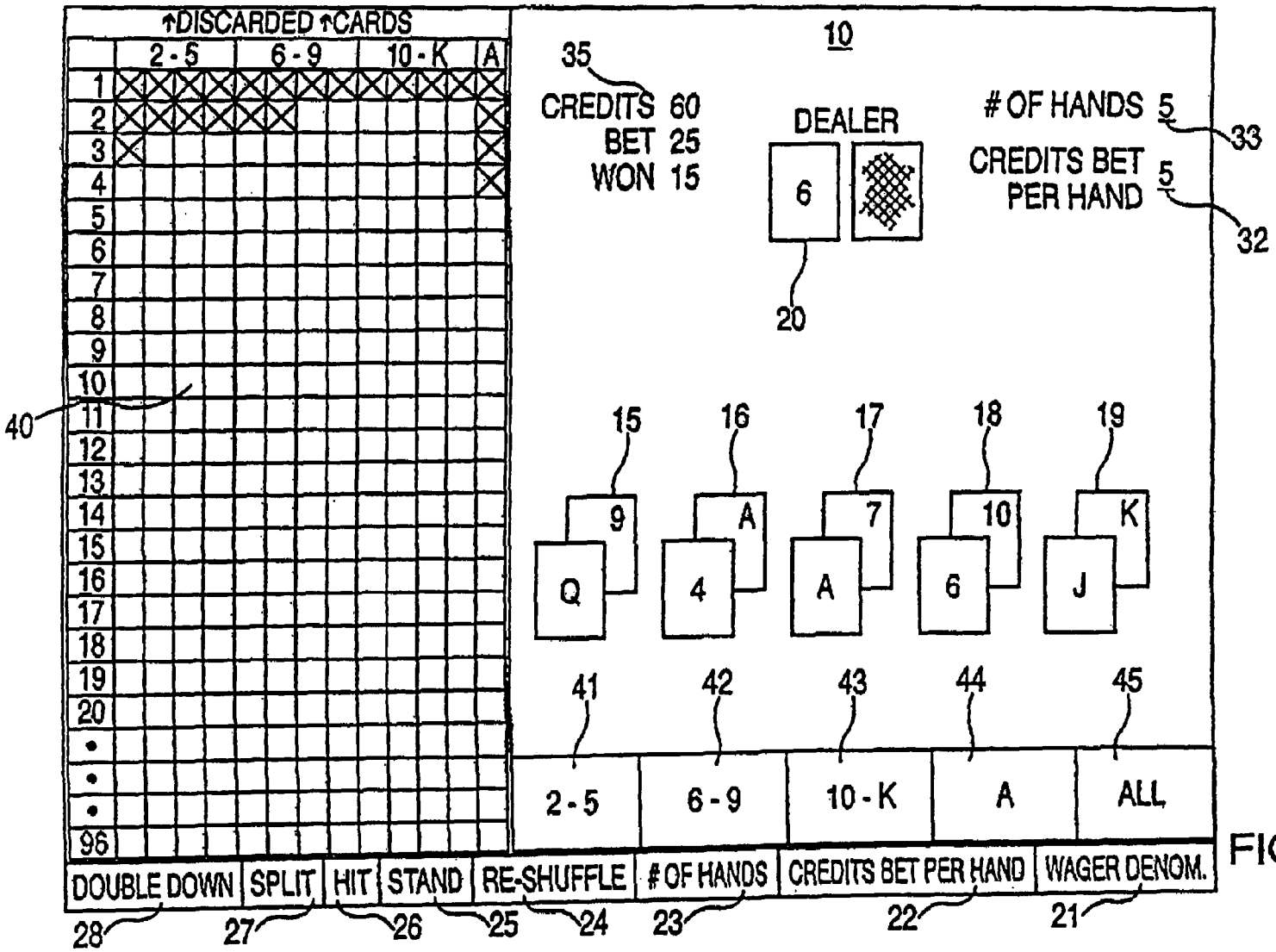
FIG. 2 illustrates an alternative screen display for use with an embodiment of the present invention.

FIG. 2 illustrates an alternative to the embodiment of the present invention shown in FIG. 1. According to the embodiment shown in FIG. 2, the "DISCARDED CARDS" display indicates ranges of cards which have been previously played. In this illustrated embodiment, the ranges are four ranges of "2-5", "6-9", "10-KING", and "ACES". While the illustrated display could have 96 rows in order to indicate the exact number of cards from each range previously played, it is also within the scope of the present invention to have alternative displays. For example, a certain segment of a column may be illuminated, colored or provided with some other discernable indicia after a certain number of cards from a given range have been discarded. Such a display might simply comprise a bar graph with or without an indication of the exact number of cards from the specific range which have been discarded.

The touch screen display of the embodiment shown in FIG. 2 is also provided with additional touch screen areas 41-45 which allow a player to input the range of card values for which he would like to see the number of discarded cards. According to this embodiment, a player may be required to pay to receive this information. For example, a player may be charged one credit to view the discarded cards in any of the discarded card ranges. Therefore, if a player wished to see how many cards ranging from TEN through KING had been displayed, he would depress "10-K" touch screen area 43 and then the information would appear on the discarded card display 40. The player would automatically be charged a single credit, or some other predetermined amount. In order to encourage use of this feature, a player could be charged less for viewing all areas. For example, if a player touched "ALL" touch area 45, the player might only be charged two or three credits.

Figure 3:
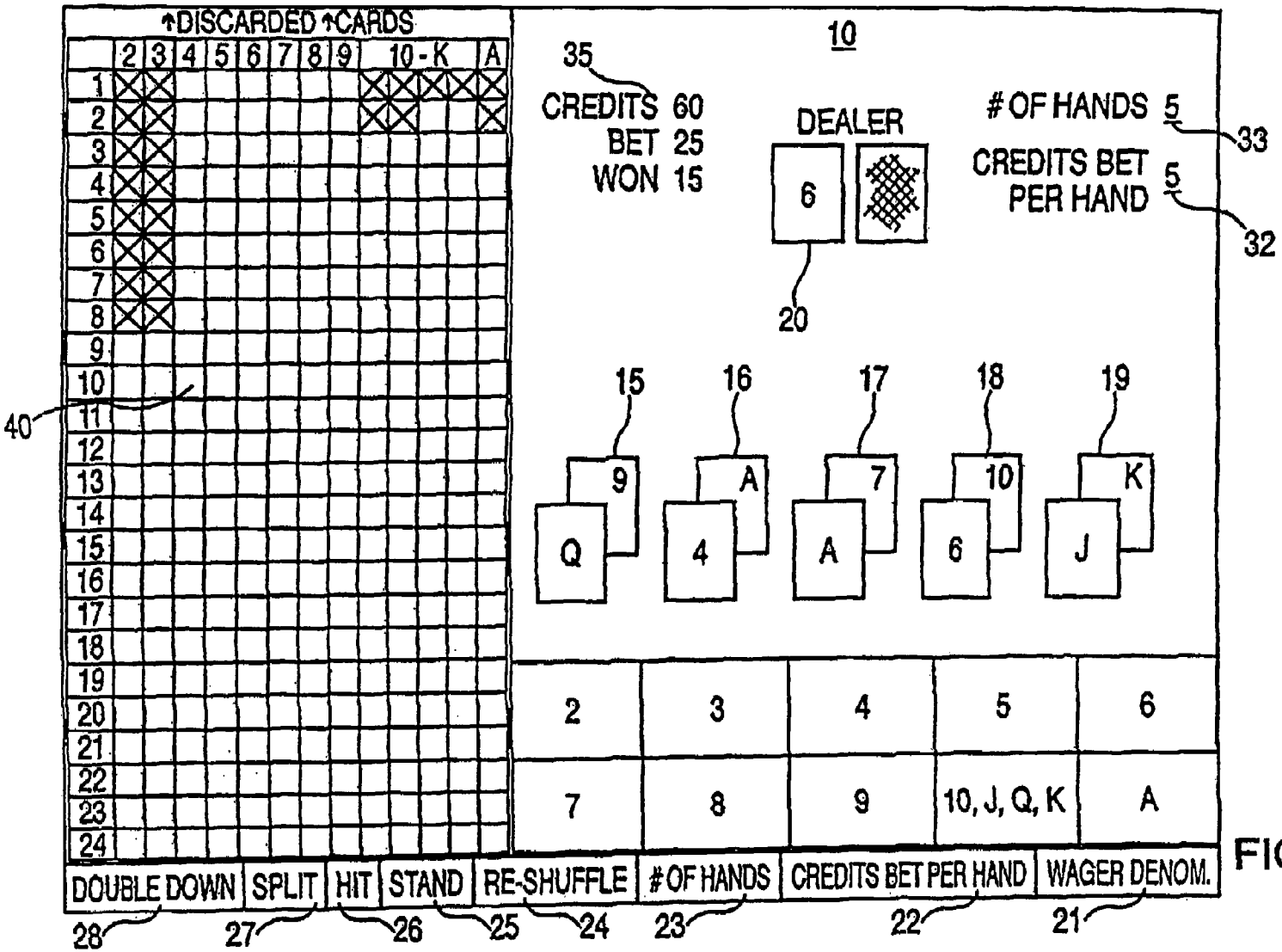
FIG. 3 illustrates a still further screen display for use with an embodiment of the present invention.

FIG. 3 illustrates a still further embodiment of the present invention. In this embodiment, only card values of ten, i.e., TENS, JACKS, QUEENS and KINGS, are provided in a single grouping.

In the embodiment shown in FIGS. 2 and 3, some or all of the information provided in "DISCARDED CARDS" display area 40 may be provided to all players whenever the game is played or in response to any predetermined criteria, e.g., the total amount wagered, the number of credits wagered, a certain amount of play on a gaming device, a certain level of activity on a player's comp card at a specific gaming facility, etc.

FIG. 4 illustrates a keno board used with another embodiment of the present invention. According to this embodiment, a first keno-type game is played wherein a plurality of numbers are selected randomly. Prior to the selection and display of those numbers, players are provided with an opportunity to wager on the numbers to be selected. For example, a typical keno game may provide a payout after selecting two to ten numbers to all players who have matched at least some predetermined number of the randomly selected numbers. According to this embodiment of the present invention, after a first keno game has been played and certain numbers have been used or eliminated for subsequent play, one or more players are provided with the opportunity to wager on the remaining numbers. Those skilled in the art will appreciate that the players will have an increased chance of winning on the second or other subsequent games since the total pool of available numbers is reduced by the number of numbers used in the previous game(s).

Figure 5:
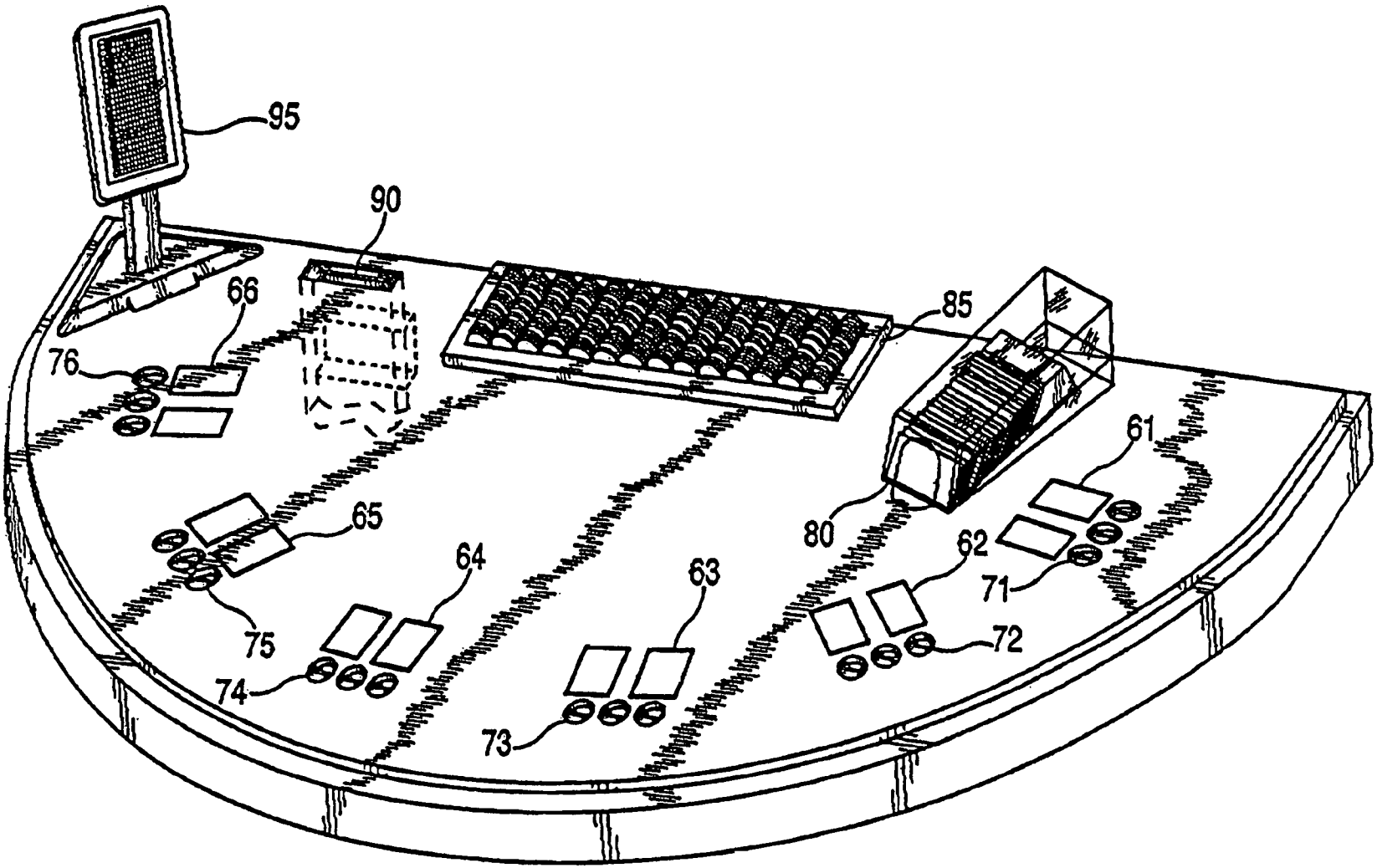
FIG. 5 illustrates a card table which can be used with another embodiment of the present invention.

FIG. 5 illustrates an alternative embodiment of the present invention in the form of a play table for actual playing cards. This illustrated embodiment comprises a plurality of player stations comprising card areas 61-66 having corresponding wager areas 71-76, respectively. A card shoe 80 and chip rack 85 are also provided in a conventional manner. In addition, this illustrated embodiment also comprises a discarded card reader 90 and a discard display 95. According to this embodiment of the present invention, discarded cards are dropped into an inlet of discarded card reader 90. The discarded card reader electronically scans the discarded cards and provides a visible indication of the discarded cards in the discarded card display 95. For these purposes, cards can be provided with some machine readable indicia, such as a bar code. Such code should be on the same side of the card that shows the card value and suit. Card reader 90 can be fashioned to scan both sides of a card therefore allowing a dealer to drop cards into card reader 90 facing either way. While the discarded card display 95 of this illustrated embodiment is shown as attached to the table, the discarded card display 95 can be mounted anywhere within sight of the players.

Figure 6:
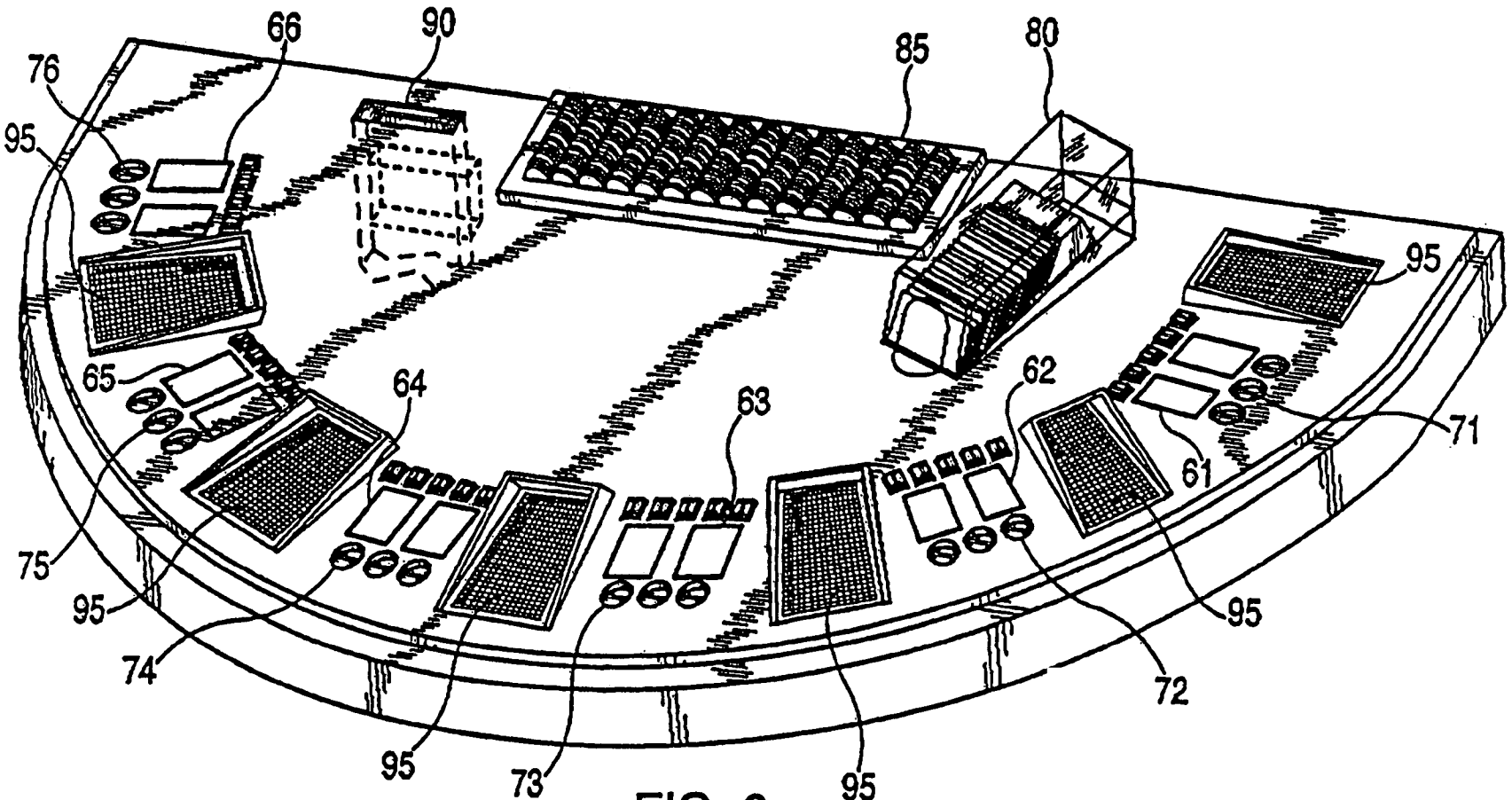
FIG. 6 illustrates a card table embodiment of the present invention wherein each player is provided with a separate screen indicating cards played from previous hands.

Additionally or alternatively, if desired, each player station can be provided with a discarded card or dealt card display as shown in FIG. 6 and players can be provided with visible access to the discard display depending upon certain criteria, or, if desired, randomly. For example, this embodiment of the present invention can provide players visual access to the discard display only if the players wager the maximum amount permitted. Alternatively, the players may be required to pay a fee, for example, five dollars prior to a wagering session which can be for a pre-determined length of time, for example two hours, if the player wishes access to the discard display. Alternatively, a common or individual discard display can be made visually accessible to one or more players in response to the success or lack of success that players have attained while playing the card game, e.g. Blackjack in this illustrated embodiment. For example, if no players win during two deals, then the discard display may be activated for the subsequent deal or until a player wins. Alternatively, the discard display may be actuated for a predetermined length of time or for a predetermined number of deals every time one or some other predetermined number of players attains a Blackjack.

The electronic and mechanical details of the discarded card reader 90 are not provided herein, but are well within the scope of one of ordinary skill in the art. For example, the playing cards can be provided with a machine readable code on the same side which displays the denomination and suit. Such a code would be readable by discard reader 90.

While the illustrated card game embodiments have been directed to Blackjack card games, other card or non-card games can be played utilizing the present invention. For example, draw poker in various forms could be played using aspects of the present invention.

According to still other embodiments of the present invention, other types of games wherein items or values are drawn from predetermined collections can also enjoy the benefits of the present invention.

The present invention is believed to be particularly attractive to players since the disclosed embodiments of the present invention provide ready access to information which was previously unavailable or difficult to remember.

The invention claimed is:

1. A game for playing a plurality of related games of chance comprising:

a first display which displays a first subset of randomly selected indicia from a predetermined collection of indicia, said first subset of randomly selected indicia being used during the play of a game of chance, wherein a specific indicia displayed on said first display during a game is not available for display on said first display during the play of subsequent related games;

a second display which displays information corresponding to a second subset of indicia which comprises indicia from first subsets from previously played related games wherein the indicia displayed on said first display in at least one subsequent play are selected from the same predetermined collection of indicia from which previously displayed indicia had been selected and to which previously selected indicia have not been returned; and wherein the display of at least some of the information displayed on said second display is dependent on some predetermined criteria.

2. A game for playing a plurality of related games of chance according to claim 1 wherein said first display and said second display are on a single screen.

3. A game for playing a plurality of related games of chance according to claim 1 wherein said second display displays information corresponding to a second subset of indicia which had previously been displayed on said first display in a plurality of plays of said related games of chance.

4. A game for playing a plurality of related games of chance according to claim 1 wherein said is selected from at least one of a card game or a keno game.

5. A game for playing a plurality of related games of chance according to claim 1 wherein said information displayed on said second display comprises the number of indicia in at least one predetermined value range of indicia used in previous plays of said game.

6. A game for playing a plurality of related games of chance according to claim 1 wherein said second display only displays said information if a predetermined successful outcome had been displayed on said first display during at least one previously played related game.

7. A game for playing a plurality of related games of chance according to claim 1 wherein said second display only displays said information if a predetermined unsuccessful outcome had been displayed on said first display during at least one previously played related game.

8. A game for playing a plurality of related games of chance according to claim 1 wherein said game receives input corresponding to a wager and said second display only displays said information if at least a predetermined amount is wagered by a player.

9. A game for playing a plurality of related games of chance according to claim 1 wherein said game comprises means for receiving player input regarding an amount wagered on the outcome of the displayed indicia in said first subset and said second display only displays said information if said player has provided input corresponding to an additional payment by at least one player.

* * * * *